US006653250B1

(12) United States Patent
Driggars

(10) Patent No.: US 6,653,250 B1
(45) Date of Patent: Nov. 25, 2003

(54) LOW-SHRINKAGE, STABLE PRINT PLATFORM KNITTED FABRIC

(75) Inventor: Sonny B. Driggars, Advance, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/676,241

(22) Filed: Sep. 29, 2000

(51) Int. Cl.[7] ..... D04B 9/00

(52) U.S. Cl. ..... 442/304; 442/312; 66/169 R; 66/191; 66/9; 66/10

(58) Field of Search ..... 442/304, 312; 66/169 R, 191, 9, 10

(56) References Cited

U.S. PATENT DOCUMENTS

| | | | | |
|---|---|---|---|---|
| 1,831,964 A | | 11/1931 | Lombardi | |
| 3,021,698 A | | 2/1962 | Hill | 66/9 |
| 3,083,439 A | | 4/1963 | Seligson | 28/72 |
| 4,244,198 A | | 1/1981 | Schaab et al. | 66/191 |
| RE30,638 E | | 6/1981 | Bryars | 66/191 |
| 5,547,733 A | * | 8/1996 | Rock et al. | 2/400 |
| 5,613,375 A | | 3/1997 | Renda et al. | 66/8 |
| 5,906,115 A | | 5/1999 | Driggars et al. | 66/191 |

FOREIGN PATENT DOCUMENTS

ES 2019523 * 6/1991

OTHER PUBLICATIONS

Sara Lee Knit Products SKU/Revision Display Style/Revision Nov. 14, 1997.

* cited by examiner

*Primary Examiner*—Elizabeth M. Cole
*Assistant Examiner*—Norca L. Torres
(74) *Attorney, Agent, or Firm*—Womble Carlyle Sandridge & Rice, PLLC

(57) ABSTRACT

A low-shrinkage, stable print platform circular knitted, cotton/synthetic fabric. The fabric is a two end fleece fabric having a weight of between about 8 to 12 oz. per sq.yd., a stitch density of between about 800 to 1000; and a face yarn count of the fabric is between about 16 to 20. In the preferred embodiment, the backing yarn count of the fabric is between about 7 to 12. The resulting fabric construction of the present invention has stretch of less than about 3% stretch in the width direction and less than about 3% stretch in the length direction when tested according to a standard stretch chart. In addition, the fabric of the present invention has shrinkage in the range of less than 5% when tested according to a standard one wash cycle. The resulting fabric is an exceptionally stable print platform, circular knitted fabric and improved pilling resistance.

22 Claims, 3 Drawing Sheets

LOW-SHRINKAGE, STABLE PRINT PLATFORM KNITTED FABRIC

CROSS-REFERENCE TO RELATED PATENT

The present application is related to U.S. patent application Ser. No. 08/971,429, filed Nov. 11, 1997 (now U.S. Pat. No. 5,906,115, issued May 25, 1999) which is hereby incorporated by reference in its entirety.

BACKGROUND OF THE INVENTION (1) Field of the Invention

The present invention relates generally to circular knitted fabric and, more particularly, to a two end fleece, cotton/synthetic blend fabric having a weight of between about 8 to 12 oz. per sq. yd and improved pilling resistance.

(2) Description of the Prior Art

The term circular knitting covers those weft knitting machines having needle beds arranged in circular cylinders and/or dials including latch, bearded and occasionally compound needle machinery. Such machines produce a wide variety of fabric structures, garments, hosiery and other articles and a variety of diameters and machine gauges. Such machines have the needles fixed in a revolving circle with the loop formation and knitting action being achieved by ancillary elements moving yarn and loops along the needle stems producing a fabric tube with the technical face facing backwards.

Large diameter circular knitting machines are generally used to produce either fleece or jersey fabrics as well as other fabric constructions. Because of the seasonal nature of these fabrics, it is usually necessary to maintain both fleece and jersey machines on the knitting floor or to move machines in and out as seasonal fabric demands change. Both approaches are capital and labor cost intensive.

One approach to solving this problem is disclosed in U.S. Pat. No. 5,613,375, issued to Renda et al., the entire disclosure hereby being incorporated by reference. This patent teaches a new and improved circular knitting machine having interchangeable section blocks and sinkers which allow the machine to be converted between producing two end fleece and 4 track jersey fabrics by simply replacing the section blocks, carrier ring, needles and sinkers without the need to strip the machine to its bed or to change the feeders or creel.

The following discussion is taken generally from Spencer, David J., Knitting Technology, (2d. ed. 1989), which is a general treatment of knitting technology.

Knitted fabrics are progressively built up by converting newly fed yarn into new loops in the needle hooks, the needles then draw these new loops head first through the old loops, which have been retained from the previous knitting cycle. The needles at the same time release, cast off or knock-over old loops so that they hang suspended by their heads from the feet of the new loops whose heads are still held in the hooks of the needles. A cohesive structure is thus produced by a combination of the intermeshed loops and the yarn joining those loops together through which it passes.

Knitted loops are arranged in rows and columns roughly equivalent to the warp and weft of woven structures termed "courses" and "wales" respectively. A course is a predominately horizontal row of loops (in an upright fabric) produced by adjacent needles during the same knitting cycle. A wale is a predominantly vertical column of needle loops produced by the same needle knitting at successive knitting cycles and thus intermeshing each new loop through the previous loop.

The term "stitch density" is frequently used in knitting instead of a linear measurement of courses and wales; it is the total number of needle loops in a square area measurement such as square inch. It is obtained by multiplying, for example, the number of courses per inch by the number of wales per inch. Stitch density tends to be a more accurate measurement because tension acting in one direction in the fabric may, for example, produce a low reading for the courses and a high reading for the wales, which when multiplied together cancel the effect out.

"Yarn count" indicates the linear density (yarn diameter or fineness) to which that particular yarn has been spun. The choice of yarn count is restricted by the type of knitting machine employed and the knitting construction. The yarn count, in turn, influences the cost, weight, opacity, handle and drapability of the resulting knitted structure. In general, staple spun yarns tend to be comparatively more expensive the finer their count, because finer fibers and a more exacting spinning process are necessary in order to prevent the yarn from showing an irregular appearance.

Historically, most systems are associated with particular yarn-spinning systems; for example, a yarn spun on the worsted system from acrylic fibers may be given a worsted count number. The worsted system is of the indirect type based on length per fixed unit mass, i.e., the higher the count number, the finer the yarn. The weight is fixed (1 lb.) and the length unit (number of 560-yard hanks) varies. 1/24's worsted (24×560-hank yards weighing 1 lb.) will be twice the cross-sectional area of 1/48's worsted (48×560-yard hanks weighing 1 lb.). 2/24's worsted indicates that the yarn contains two ends of 1/24's so that the resulting count is twice the cross-sectional area (24/2=12's).

Three end and two end, course cut (10 to 14), knitting techniques are conventionally used to produce knitted fleece with low stitch densities (600–700). Fabric with a higher stitch density is generally perceived to be a higher quality fabric because it has a lower shrinkage rate and a more stable print platform. The term stable print platform is intended to be given its normal meaning, that is, a fabric that is sufficiently stable to be capable of receiving printed indicia or images and retaining those indicia or images during the normal course of wear and wash.

Two end, course cut knitting techniques are generally used to produce knitted fleece fabric with lower stitch density, which is generally perceived to be low quality fabric. Two end knitted fleece fabric constructions are typically less costly to produce compared to three end knitted fleece fabric constructions because of lower yarn material costs.

Both three end and two end course cut knitting techniques can be used to produce knitted fleece fabric having the same fabric weight and the same stitch density. However, because three end knitting uses three yarn ends, as opposed to two yarn ends used by two end knitting, a yarn having a finer yarn count, which is significantly more expensive, is necessary to produce knitted fleece fabric with the same fabric weight and same stitch density. Thus, it is much more costly to produce knitted fleece fabric of a given weight and stitch density using a three end knitting technique.

In addition, one well-known problem associated with knitted fabrics constructed of yarn that is a blend of cotton and polyester is pilling. Typically, in a blended yarn, the cotton fibers are not as strong relative to the polyester fibers. These cotton fibers have tendency to break when a garment, or other article, constructed of knitted fabric is worn, washed or is otherwise abraded. The cotton fibers then become attached to hook-like ends of the polyester fibers, resulting in small balls, or pills, of cotton fibers. Pilling is undesirable to consumers of products, such as apparel, made with knitted fabric constructed of blended yarn since the "new" appearance of the garment is quickly loss. This is even more apparent in printed fabric since the printing quickly becomes fuzzy because of the pills.

One way to reduce pilling is to knit fabric from airjet spun yarn rather than open end spun yarn. Airjet spinning, however, disadvantageously requires equipment that is different than that used to produce open end spun yarn. The acquisition and maintenance of airjet spinning equipment adds considerably to the cost of yarn production and the knitted fabric which is made from the airjet spun yarn. For many existing plants converting to airjet spinning or buying airjet spun yarn would be cost prohibitive.

Thus, there remains a need for a new and improved knitted fleece, cotton/synthetic blend fabric that can be produced economically, and which has a relatively high stitch density and correspondingly low shrinkage rate and improved pilling resistance, and that has an extremely stable print platform. This has been found possible to achieve using a two end, fine cut (greater than about 14) knitting technique using more economical yarns than possible with three ends and a significantly higher stitch density and by reducing the amount of synthetic yarn in the face of the fabric below about 50 wt. %.

SUMMARY OF THE INVENTION

The present invention is directed to a stable print platform circular knitted fabric. In a preferred embodiment, the fabric has low shrinkage, low stretch and improved pilling resistance properties. The fabric is a two end fleece cotton/synthetic blend fabric having a weight of between about 8 to 12 oz. per sq. yd., a stitch density of between about 800 to 1000; and wherein the face of the fabric is about 25 wt. % synthetic for improving pilling resistance of the face of the fabric and the back of the fabric is about 75 wt. % synthetic for forming about a 50/50 total cotton/synthetic blend fabric. The face yarn count of the fabric is between about 16 to 20. In the preferred embodiment, the backing yarn count of the fabric is between about 7 to 12.

In the preferred embodiment, the fabric is formed from an acrylic-free cotton blend. Specifically, the fabric is formed from an acrylic-free cotton blend containing between about 50 to 90 percent cotton and the balance is polyester.

The resulting fabric construction of the present invention has stretch of less than about 3% stretch in the width direction and less than about 3% stretch in the length direction when tested according to a standard stretch chart. In addition, the fabric of the present invention has shrinkage in the range of less than 5% when tested according to a standard one wash cycle. The resulting fabric is an exceptionally stable print platform circular knitted fabric and has improved pilling resistance.

Accordingly, one aspect of the present invention is to provide a low-shrinkage, stable print platform circular knitted fabric The fabric includes (a) a two end fleece, cotton/synthetic blend fabric having a weight of between about 8 to 12 oz. per sq.yd.; and (b) a stitch density of greater than about 800, wherein the face of the fabric is less than 50 wt. % synthetic for improved pilling resistance of the face of the fabric.

Another aspect of the present invention is to provide a low-shrinkage, stable print platform circular knitted fabric. The fabric includes: (a) a two end fleece, cotton/synthetic blend fabric having a weight of between about 8 to 12 oz. per sq.yd.; and (b) a stitch density of between about 800 to 1000, wherein the face of the fabric is about 25 wt. % synthetic for improved pilling resistance of the face of the fabric and the back of the fabric is about 75 wt. % synthetic for forming about a 50/50 total cotton/synthetic blend fabric.

Still another aspect of the present invention is to provide a low-shrinkage, stable print platform circular knitted fabric. The fabric including: (a) a two end fleece, cotton/synthetic blend fabric having a weight of between about 8 to 12 oz. per sq.yd.; (b) a stitch density of between about 800 to 1000, wherein the face of the fabric is about 25 wt. % synthetic for improved pilling resistance of the face of the fabric and the back of the fabric is about 75 wt. % synthetic for forming about a 50/50 total cotton/synthetic blend fabric; and (c) wherein the denier of the face yarn of the fabric is greater than about 2 for further improved pilling resistance of the face of the fabric.

These and other aspects of the present invention will become apparent to those skilled in the art after a reading of the following description of the preferred embodiment when considered with the drawings.

DESCRIPTION OF THE PREFERRED EMBODIMENTS

Figure 1:
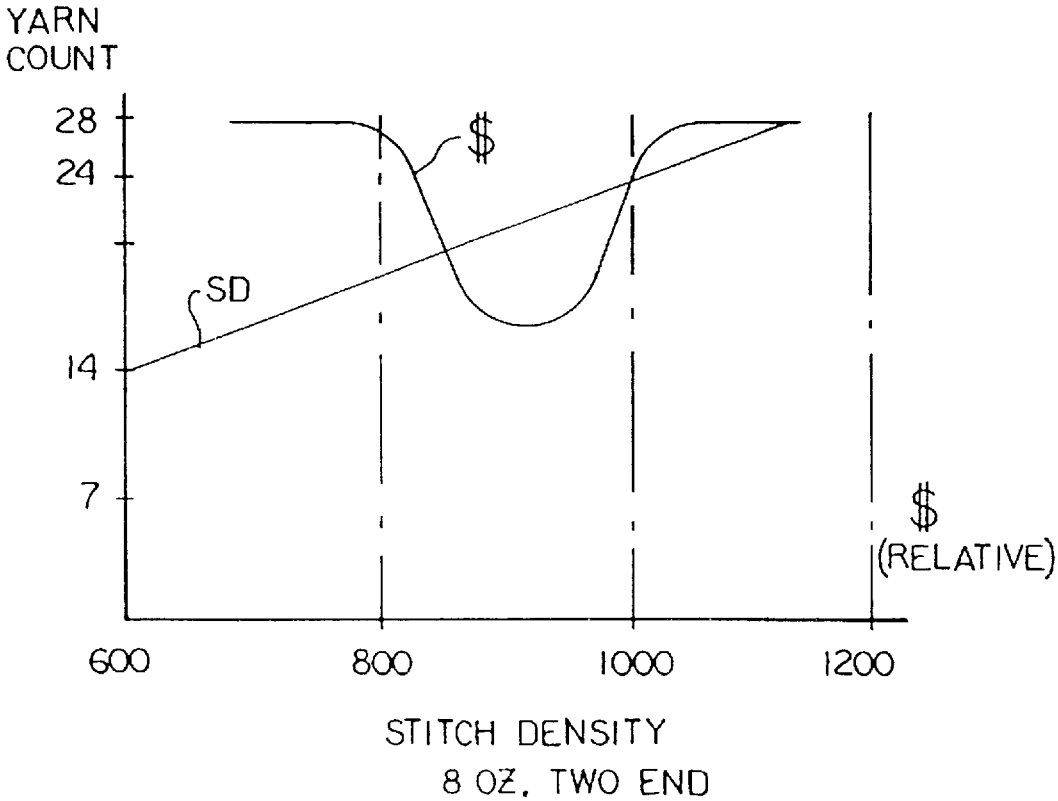
FIG. 1 is a graphical representation illustrating the relationship of face yarn count and cost verses stitch density for a representative 8 oz. fleece fabric constructed according to the present invention.

In the following description, like reference characters designate like or corresponding parts throughout the several views. Also in the following description, it is to be understood that such terms as "forward","rearward", "left", "right", "upwardly", "downwardly", and the like are words of convenience and are not to be construed as limiting terms. In addition in the following description, the blend designation X/Y blend refers to a cotton/synthetic blend in weight percent, X representing the weight percent of cotton fiber and Y representing the weight percent synthetic fiber. For example, an about 25/75 blend would be about 25 weight percent cotton fiber and about 75 weight percent synthetic fiber blend; an about 50/50 blend would be about 50 weight percent cotton fiber and about 50 weight percent synthetic fiber blend; and about 75/25 blend would be about 75 weight percent cotton fiber and about 25 weight percent synthetic fiber blend.

The present invention can be practiced using the convertible circular knitting machine set forth in the above-referenced U.S. Pat. No. 5,613,375. Such a machine includes a conventional fleece circular knitting machine adaptable to be converted to a jersey circular knitting machine. The knitting machine includes four major subassemblies: a creel having a plurality of yarn packages; a plurality of feeders; a knitting cylinder supported on a bed and having a plurality of needles; and a plurality of fleece section blocks attached to the bed and arranged about the perimeter of the cylinder.

Jersey fabric is usually knit on four feeds per block. Renda et al. '375 found that it was possible to design jersey cams and section blocks that are interchangeable with the fleece section blocks. This allows one cylinder to produce two types of fabric with the same cylinder. All that was necessary is to replace the interchangeable section blocks, the carrier ring, and the needles and sinkers. The cut remains the same as well as the creel and number of feeders.

In knitting fleece, it is necessary to have three yarns to make one course. Only one yarn is necessary to knit a course of jersey fabric. Accordingly, one cam and one yarn will knit one course of jersey fabric. Three cams in each block would make three courses of jersey fabric. Three times 36 jersey section blocks would make 108 courses per cylinder revolution. The more cams around the circumference, the more production.

The conventional fleece section block has two dials associated with two upper feeds each supplying one yarn and a third yarn being supplied to the fleece sinker. It puts the loop in, i.e. the yarn that gets napped for the pile. The fleece section block has a guide on top of the sinker section, which feeds yarn into the sinker, and the sinker determines the length of the loop it is going to make.

As best seen in FIG. 1, it has been found that only two end circular knitted fabric having a limited range of stitch density for a given fabric weight will produce a low shrinkage, stable print platform which is not cost prohibitive. The conventional wisdom of using a three end fleece and increasing the stitch density above the normal range of about 600 requires a corresponding higher yarn count because of the presence of the 3rd yarn. The cost of these higher yarn count yarns increase non-linearly resulting in a fabric which would be twice as expensive as a two end circular knitted fabric produced according to the present invention. This drives the acceptable stitch density ranges of the present invention.

In the preferred embodiment, as taught by Renda et al. '375, the fleece sinkers are adapted for use with the fleece section blocks for producing fleece fabric and the jersey sinkers are adapted for use with the jersey section blocks for producing jersey fabric. Each of the fleece sinkers and each of the jersey sinkers includes a nose, a first throat below the nose and a knit line adjacent to the throat. Each of the fleece sinkers and each of the jersey sinkers have substantially the same outer dimensions to facilitate conversion of the circular knitting machine between production of fleece and jersey fabrics. After knitting, the fabric is finished in a conventional manner.

Figure 2A:
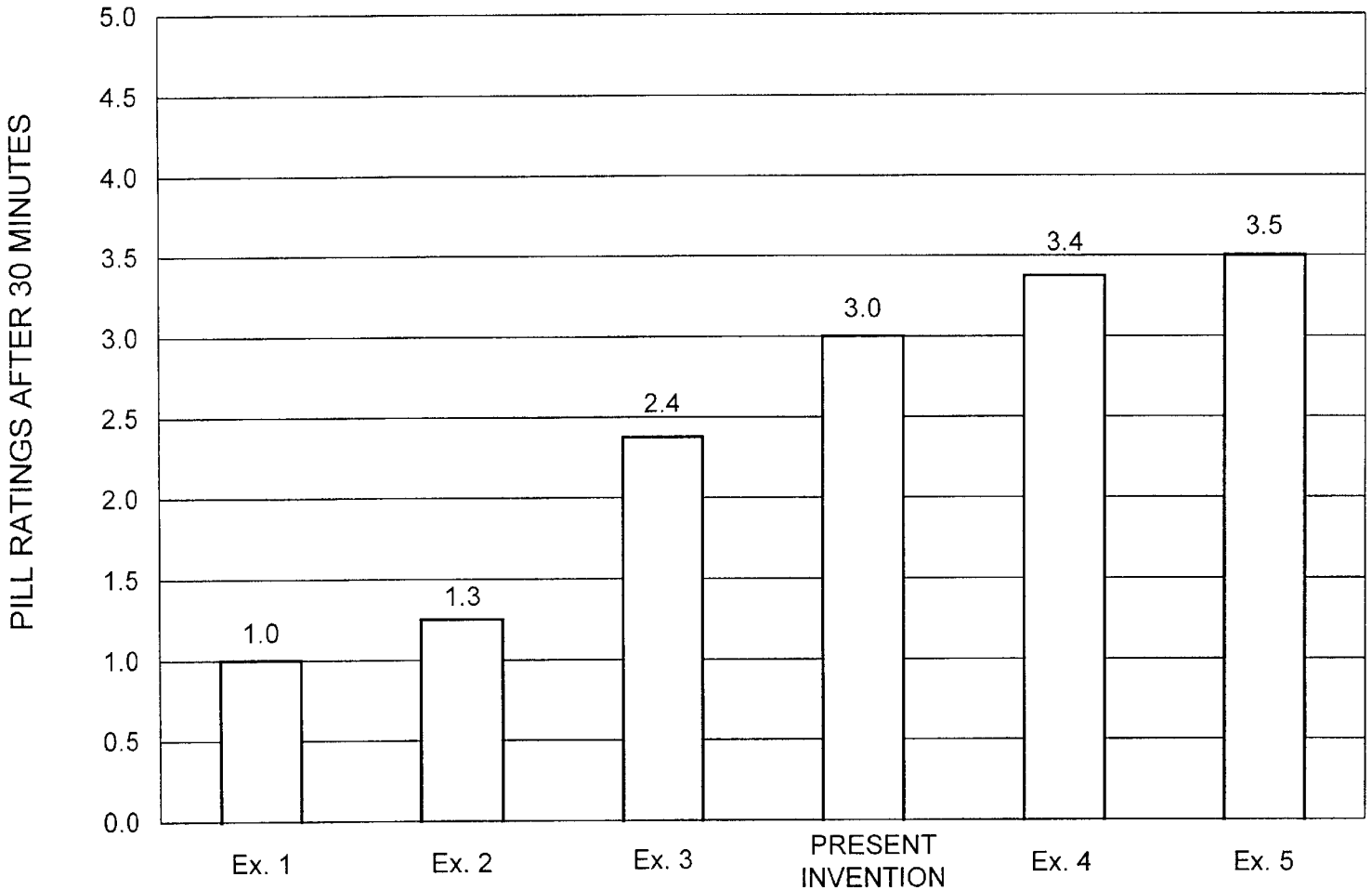
FIGS. 2A and 2B are graphical representations illustrating the pilling resistance for a fleece fabric constructed according to the present invention compared to the pilling resistance for fleece fabrics constructed according to alternative methods after 30 minutes and 60 minutes of testing, respectively.
Figure 2B:
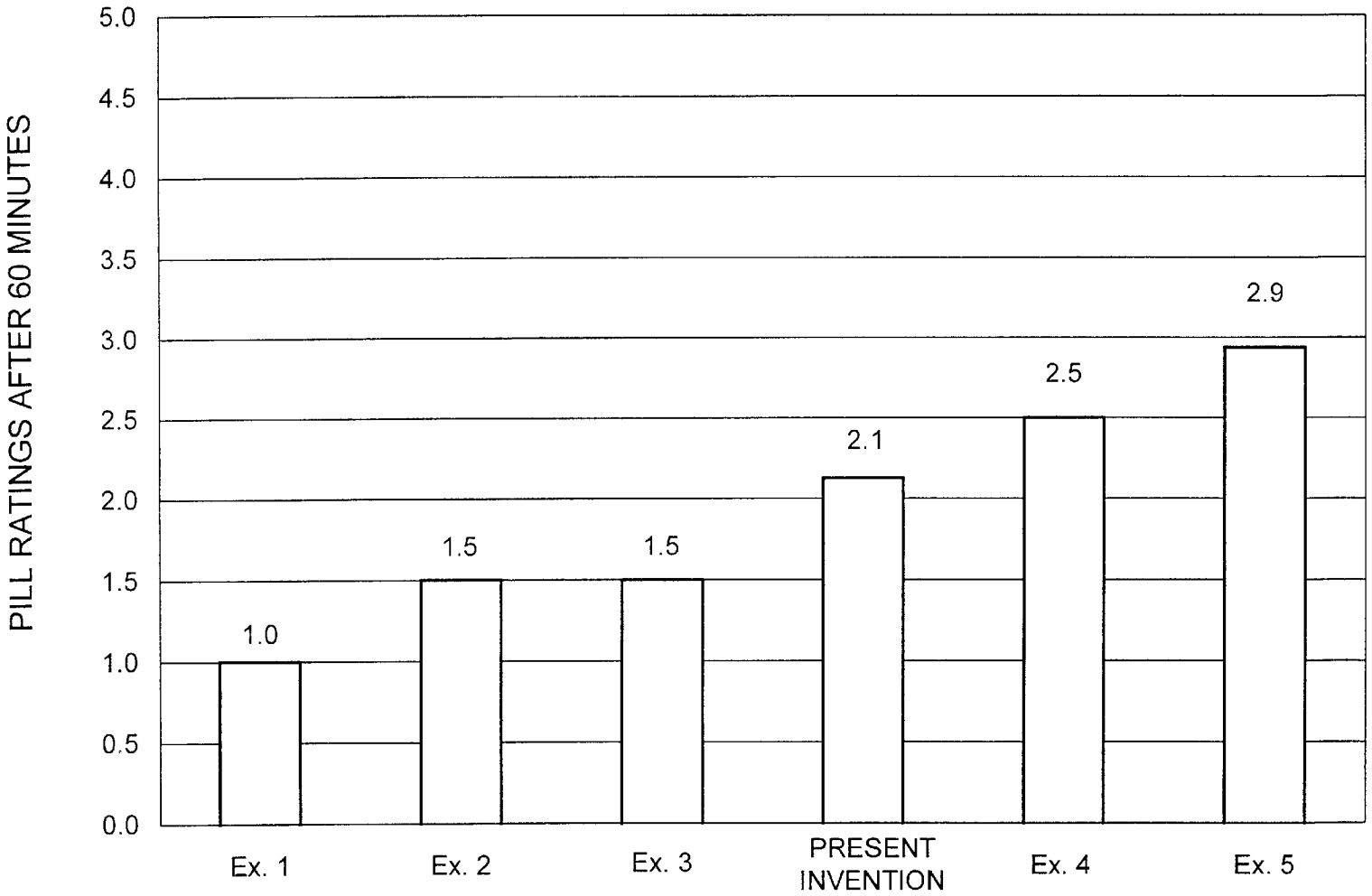

As best seen in FIGS. 2A and 2B, the pilling of open end spun yarn can be advantageously reduced by reducing the amount of polyester used to make the blended yarn. The use of less polyester fiber results in fewer hook-like ends to which the broken cotton fibers can attach themselves. FIGS. 2A and 2B are graphical representations illustrating the pilling resistance, stated in terms of the pill rating, for a fleece fabric constructed according to the present invention compared to the pilling resistance for fleece fabrics constructed according to alternative methods after about 30 minutes and about 60 minutes of testing, respectively.

Samples made according to Examples 1 through 5 and the present invention were tested for pilling resistance using the Random Tumble Pilling test procedure (ASTM D3512-82 test method). Example 1 was an about 50/50 blend of cotton and polyester, open end spun, two-end fleece fabric, which had a pill rating of about 1.0 after both about 30 minutes and about 60 minutes of testing. Example 2 was also an about 50/50 blend of cotton and polyester, open end spun, two-end fleece fabric which had a pill rating of about 1.3 after about 30 minutes of testing and about 1.5 after about 60 minutes of testing. Example 3 was an about 50/50 blend of cotton and polyester, air jet spun, two-end fleece fabric, which had a pill rating of about 2.4 after about 30 minutes of testing and about 1.5 after about 60 minutes of testing. Example 4 was an about 50/50 blend of cotton and polyester, air jet spun, three-end fleece fabric, which had a pill rating of about 3.4 after about 30 minutes of testing and about 2.5 after about 60 minutes of testing. Example 5 was also an about 50/50 blend of cotton and polyester, air jet spun, three-end fleece fabric, which had a pill rating of about 3.5 after about 30 minutes of testing and about 2.9 after about 60 minutes of testing.

The present invention is an about 75/25 blend of cotton and polyester face combined with about 25/75 blend of cotton and polyester back (effectively yielding about 50/50 total blend of cotton and polyester), open end spun, about 2.35 denier, two-end fleece fabric, which had a pill rating of about 3.0 after about 30 minutes of testing and about 2.1 after about 60 minutes of testing.

The pill rating for the fleece fabric made according to present invention is clearly better than the pill ratings for other open end spun, two-end fleece fabrics. Also, the pill rating for the fleece fabric made according to present invention is better than the pill rating for the air jet spun, two-end fleece fabric. Moreover, the pill rating for the fleece fabric made according to present invention is nearly as good as the pill ratings for the air jet spun, three-end fleece fabrics.

By comparison, high-cotton, open end spun and airjet spun, two-end and three-end fleece fabrics have a pill rating of about 3.5 to about 4.0 (e.g., high-cotton, open end spun, two-end fleece fabrics have a pill rating of about 3.5; high-cotton, air jet spun, two-end fleece fabrics have a pill rating of about 3.5; and high-cotton, three-end fleece fabrics have a pill rating of about 4.0).

Another way to reduce pilling is to increase the denier of the polyester fiber used to make the blended yarn as discussed in U.S. patent application Ser. No. 09/256,981, filed Feb. 24, 1999 (now U.S. Pat. No. 6,253,582, issued Jul. 3, 2001) which is hereby incorporated by reference in its entirety. If the denier of the blended yarn is held constant, the increase in the denier of the polyester fiber advantageously results in fewer polyester fibers in the blended yarn. Again, fewer polyester fibers results in fewer hook-like ends to which the broken cotton fibers can attach themselves, which, in turn, advantageously reduces pilling.

Furthermore, the increase in denier of the polyester fiber decreases the number of polyester fibers in the blended yarn, which disadvantageously reduces the strength of the blended yarn. This is because there are few polyester fibers in a cross-section of the blended yarn.

The decrease in the strength of the blended yarn can be offset, at least to some extent, by increasing the twist multiple of the yarn. A "twist multiple" is the number of turns per inch in a yarn. A yarn with a higher twist multiple is relatively stronger than the same yarn with a lower twist multiple. There is, however, a practical upper limit to the twist multiple. If a twist multiple is too high the knittability of the yarn is adversely affected because the yarn will become skewed and has a tendency to kink. Yams with relatively high twist multiples also result in a knitted fabric with a harsher hand, which is generally undesirable. In one preferred embodiment of the present invention, the twist multiple of the face yarn of the fabric is greater than about 3.5 for improved strength of the face yarn.

Certain modifications and improvements will occur to those skilled in the art upon a reading of the foregoing description. By way of example, the preferred stitch density of the two end fleece fabric is between about 800 to 1000, new developments in yarn manufacture, such as vortex spinning, could reduce yarn costs for finer yarns and allow stitch densities to increase to 1100. Also, while the preferred embodiment is an 8 oz. fabric, the basic techniques of the present invention may allow high stitch density fabrics to increase to 9½ oz. It should be understood that all such modifications and improvements have been deleted herein for the sake of conciseness and readability but are properly within the scope of the following claims.

I claim:

1. A stable print platform circular knitted fabric, said fabric comprising:

(a) a two-end fleece, cotton/synthetic blend fabric having a face and a back and weight of between about 8 to 12 oz. per square yard, wherein both the face and the back of the fabric comprises a blend of cotton and synthetic fibers;

(b) a stitch density of greater than about 800; and (c) wherein the face of said fabric is less synthetic than the back of the fabric, for forming about a 50/50 total cotton/synthetic blend fabric.

2. The fabric according to claim 1, wherein the denier of the face yarn of said fabric is greater than about 2.

3. The fabric according to claim 2, wherein the twist multiple of the face yarn of said fabric is greater than about 3.5

4. The fabric according to claim 1, wherein the face yarn count of said fabric is between about 16 to 20.

5. The fabric according to claim 4, wherein the backing yarn count of said fabric is between about 7 to 12.

6. The fabric according to claim 1, wherein said fabric is formed from an acrylic-free cotton blend.

7. The fabric according to claim 6, wherein said fabric formed from an acrylic-free cotton blend contains between about 50 to 90 percent cotton.

8. The fabric according to claim 6, wherein said fabric formed from an acrylic-free cotton blend contains between about 50 to 90 percent cotton and the balance is polyester.

9. A stable print platform circular knitted fabric, said fabric comprising:

(a) a two end fleece cotton/synthetic blend fabric having a weight of between about 8 to 12 oz. per sq. yd.; and (b) a stitch density of between about 800 to 1000, wherein the face of said fabric is about 25 wt. % synthetic and the back of said fabric is about 75 wt. % synthetic for forming about a 50/50 total cotton/synthetic blend fabric.

10. The fabric according to claim 9, wherein said fabric has stretch of less than about 3% stretch in the width direction and less than about 3% stretch in the length direction when tested according to a standard stretch chart.

11. The fabric according to claim 9, wherein said fabric has shrinkage in the range of less than 5% when tested according to a standard one wash cycle.

12. A stable print platform circular knitted fabric, said fabric comprising:

(a) a two end fleece, cotton/synthetic blend fabric having a weight of between about 8 to 12 oz. per sq. yd.;

(b) a stitch density of between about 800 and 1000, wherein the face of said fabric is about 25 wt. % synthetic and the back of said fabric is about 75 wt. % synthetic for forming about a 50/50 total cotton/synthetic blend fabric; and (c) wherein the denier of the face yarn of said fabric is greater than about 2.

13. The fabric according to claim 12, wherein the twist multiple of the face yarn of said fabric is greater than about 3.5.

14. The fabric according to claim 12, wherein the face yarn count of said fabric is between about 16 to 20.

15. The fabric according to claim 14, wherein the backing yarn count of said fabric is between about 7 to 12.

16. The fabric according to claim 12, wherein said fabric is formed from an acrylic-free cotton blend.

17. The fabric according to claim 16, wherein said fabric formed from an acrylic-free cotton blend contains between about 50 to 90 percent cotton.

18. The fabric according to claim 16, wherein said fabric formed from an acrylic-free cotton blend contains between about 50 to 90 percent cotton and the balance is polyester.

19. The fabric according to claim 12, wherein said fabric has stretch of less than about 3% stretch in the width direction and less than about 3% stretch in the length direction when tested according to a standard stretch chart.

20. The fabric according to claim 12, wherein said fabric has shrinkage in the range of less than 5% when tested according to a standard one wash cycle.

21. The fabric according to claim 1, wherein said fabric has stretch of less than about 3% stretch in the width direction and less than about 3% stretch in the length direction when tested according to a standard stretch chart.

22. The fabric according to claim 1, wherein said fabric has shrinkage in the range of less than 5% when tested according to a standard one wash cycle.

* * * * *